United States Patent [19]

Puls

[11] Patent Number: 4,536,173

[45] Date of Patent: Aug. 20, 1985

[54] CUP MAKING APPARATUS WITH LUBRICATING MEANS

[75] Inventor: Craig Puls, Slinger, Wis.

[73] Assignee: Holiday Cups, Inc., Menomonee Falls, Wis.

[21] Appl. No.: 469,217

[22] Filed: Feb. 24, 1983

[51] Int. Cl.[3] ..... B31B 49/02

[52] U.S. Cl. ..... 493/149; 493/107; 493/109; 493/158; 493/328

[58] Field of Search ..... 493/159, 158, 149, 148, 493/328, 330, 108, 107, 106, 105, 109

[56] References Cited

U.S. PATENT DOCUMENTS

| | | | |
|---|---|---|---|
| 1,571,180 | 2/1926 | Astley | 493/328 |
| 1,735,721 | 12/1929 | Barro | 493/158 |
| 2,352,652 | 7/1944 | Morton et al. | 493/148 |
| 3,336,847 | 8/1967 | Durat | 493/158 |
| 4,409,045 | 10/1983 | Busse | 493/106 |

*Primary Examiner*—Daniel C. Crane
*Assistant Examiner*—David B. Jones
*Attorney, Agent, or Firm*—Fred Wiviott

[57] ABSTRACT

A method of making cups includes forming blanks of a cup sidewall portion, lubricating the upper inside edge of the cup prior to forming the same into a substantially frusto-conical configuration by sealing its opposite edges and the application of tools which curl and then roll the upper edge of the sidewall portion to form the cup rim. The lubricant is applied to the sidewall blank by means of an applicator consisting of an arcuate wick secured between a pair of mounting plates which move the wick into engagement with each blank between the die cutter and the cup forming stations.

5 Claims, 4 Drawing Figures

CUP MAKING APPARATUS WITH LUBRICATING MEANS

BACKGROUND OF THE INVENTION

The invention relates to cup forming machines and more particularly to a method and apparatus for lubricating the upper edge of the cup blank prior to formation of the cup rim.

Automatic machines for making cups or other containers from paper stock are well known. Such machines may, for example, be used for preparing drinking cups for hot or cold liquids. The paper stock employed in such cup making machines may be coated on one or both sides with a resin material, such as polyethylene which serves to protect the paper stock from penetration by liquids.

In such cup forming machine the paper stock is provided as rolls from which the sidewall and bottom portions of the cup are cut by means such as blanking dies. After the sidewall blanks have been cut, they are transferred to a mandrel assembly where they are wrapped around a mandrel with overlapping edges which are then sealed with an adhesive or by the application of heat. The sidewall is clamped in position until the adhesive is set or the heated polyethylene has hardened. In the meantime, the bottom blanks are formed by a pressing die into a shallow cupped configuration and are then applied to the end of the mandrel holding the formed sidewall. Adhesive or heat may then be used to seal the bottom to the sidewall. The cup is then transferred to a rim forming station. Here, the cup is held by means such as a vacuum in a pocket while its upper end is engaged by tools which curl and then roll the edge back around itself to form the rim. Because of the high frictional forces which occur during the rim forming operation, prior art cup making machines applied a lubricant to the rim of the cup prior to the application of the rim forming tool. The lubricant was applied to the cup by means of a spray device or an annular wick after the formed cup was transferred from the forming mandrel to the vertically oriented rimming pockets.

Such prior art methods and apparatus for applying lubricant were found to be unsatisfactory because the lubricating material such as silicone or mineral oil tend to drip into the cup rendering them unsatisfactory.

SUMMARY OF THE INVENTION

It is an object of the invention to provide a new and improved cup forming method.

A further object of the invention is to provide a new and improved lubricant applicator for cup forming machines.

Another object of the invention is to provide a method of forming machines wherein the cups are not contaminated by lubricant employed during the rim forming operation.

These and other objects and advantages of the present invention will become more apparent from the detailed description thereof taken with the accompanying drawings.

In general terms, the invention comprises a method of making cups which includes the steps of forming blanks of the cup sidewall portion, forming the cups into a frusto-conical configuration by joining the edges of the blank, applying lubricant to the upper inside edge of the blank prior to joining the edges thereof, and forming a rim on the sidewall portion by engaging the same with a tool which rolls the edge for forming a rim thereon. The lubricant applicating apparatus according to the invention comprises an arcuate wick disposed between a pair of carrier plates such that the inner lower edge of the wick is exposed. The applicator is mounted for reciprocating movement into and out of engagement with the cup blanks and synchronism with the blank die cutter.

DESCRIPTION OF THE PREFERRED EMBODIMENT

Figure 1:
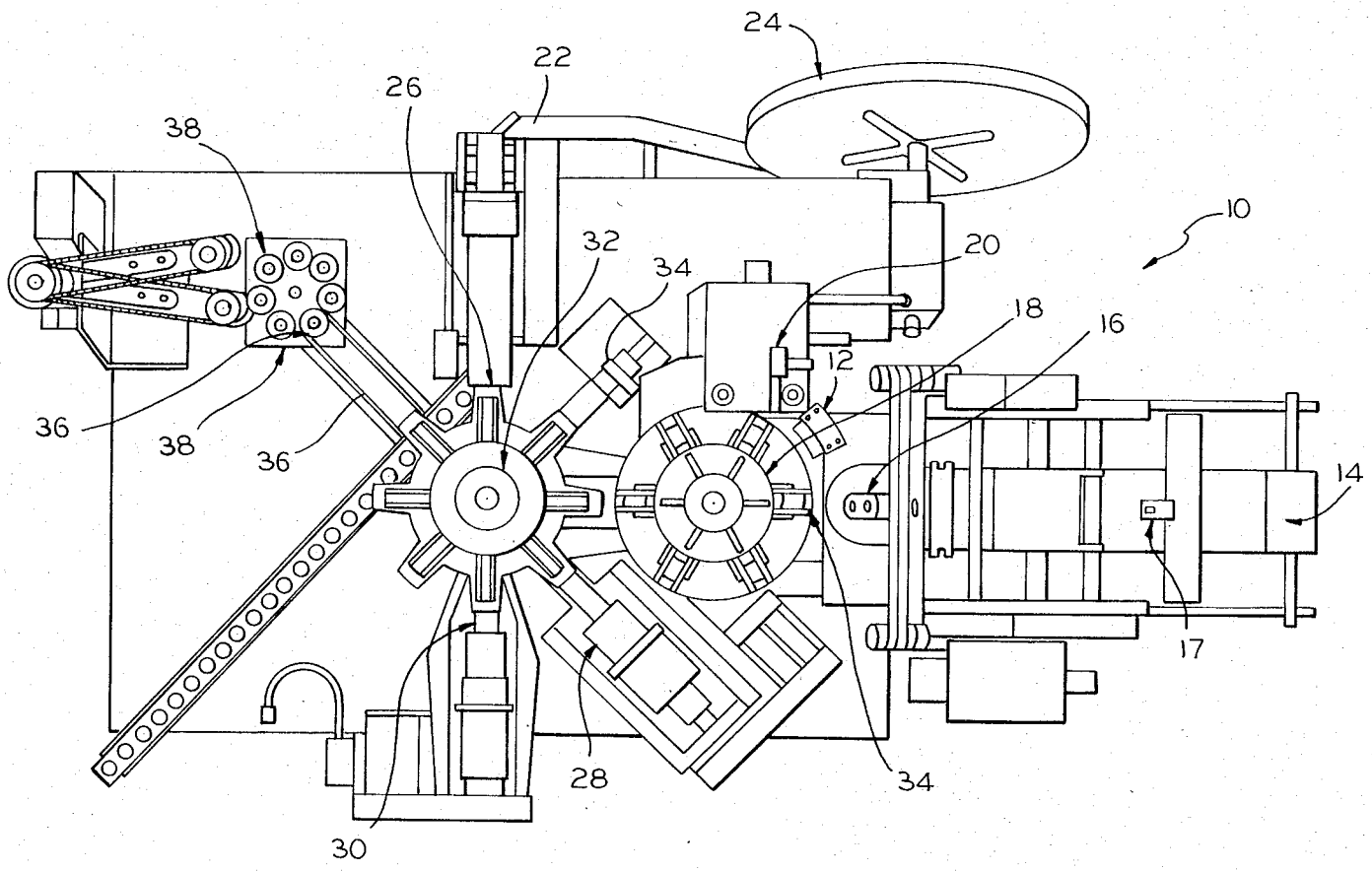
FIG. 1 schematically illustrates an automatic cup making machine with which the applicator according to the present invention may be employed.

FIG. 1 illustrates an example of a cup forming machine 10 with which the applicator 12 in accordance with the invention may be employed. The illustrated cup forming machine is well known in the art and accordingly will not be discussed in detail. It will be sufficient for the purposes of understanding the invention that the sidewall stock 14 is fed from a sidewall stock roll stand (not shown) to a sidewall blanking die 16 by means of a sidewall feeder 17. The blanking die cuts the sidewall blanks which are then transported past the applicator 12 by a sidewall transfer turret 18. After application of the lubricant, the blanks are transferred to a preheat station 20 where the polyethylene coatings are preheated. In the meantime, the bottom stock 22 is fed from a bottom stock roll stand 24 to a bottom blanking device 26. The bottom blanks are then preformed by a bottom incurler 28 and a bottom finisher 30 before they are placed on the ends of individual mandrels of the mandrel turret 32.

After passage through the preheater 20, the sidewall blanks are delivered to a folder 34 which wraps them around one of the mandrels of turret 32 and upon which a cup bottom is also placed. After the edges of the sidewall blank have been overlapped, a sidewall seam clamp is actuated to apply pressure and heat to the seam for sealing. The cups are then discharged through a chute 36 into the individual pockets of the rim finishing turret 38. Here, a shaped tool curls the upper edge of the cup sidewall outwardly to begin formation of the finished rolled rim after which the cup passes to a heated forming tool which turns the upper curled rim down and around on itself to complete the rim roll. Proper lubrication of the cup rim is necessary to avoid high temperatures which would otherwise occur as a result of frictional forces generated during the rim forming operation.

Figure 2:
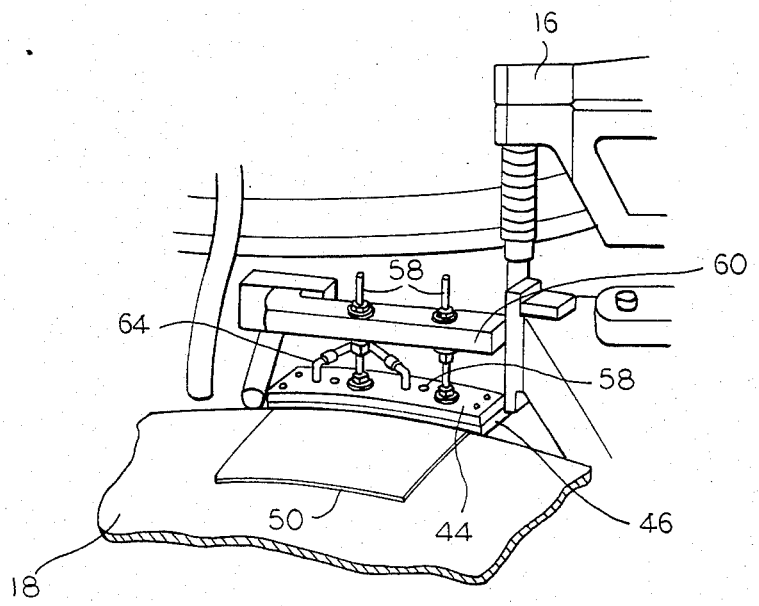
FIG. 2 is a perspective view of the applicator in accordance with the preferred embodiment of the invention.
Figure 3:
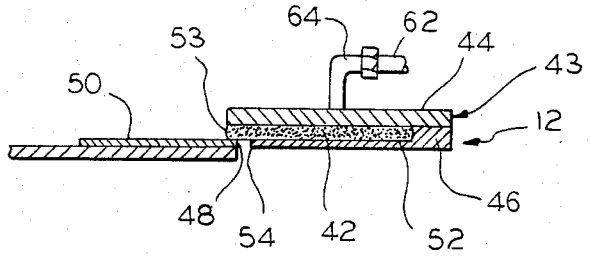
FIG. 3 is a cross-sectional view of the applicator shown in FIG. 2.
Figure 4:
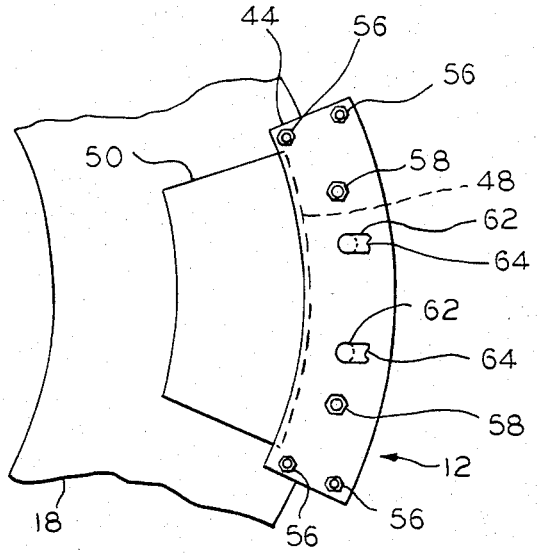
FIG. 4 is a top plan view of the applicator shown in FIG. 2.

The lubrication applicator 12 according to the preferred embodiment of the invention is disposed between the sidewall blanking die 16 and the heat transfer tunnel 18 and is shown in FIGS. 2, 3 and 4 to include a wick 42 mounted in a carrier 43 consisting of upper and lower support plates 44 and 46. The wick 42 and the plates 44 and 46 are generally complimentary arcuate segments with their inner edges conforming generally to the curvature of the upper edge 48 of the cup blank 50. The bottom plate 46 has a shallow recess 52 for receiving the wick 42 and its width is less than that of the upper plate 44 so that the inner edge 53 of wick 42 overhangs the inner edge 54 of plate 46.

The plates 44 and 46 may be held in an opposed relation with the wick 42 clamped therebetween in any suitable manner such as by means of bolts 56. In addition, the assembly is suspended by bolts 58 from a frame 60 which is secured to and extends laterally from the sidewall blanking die 16 for vertical movement therewith. After each blank 50 is cut, it is transported by sidewall transfer turret 18 to a position beneath applicator 12 and with its edge 48 oriented beneath the edge 53 of wick 42. Accordingly, each time the blanking die 16 descends to cut a sidewall blank, the applicator 41 will move downwardly in synchronism therewith. The stroke and orientation of the applicator 12 is such that its edge 53 will engage the edge 58 of blank 50 for lubricating the same. Lubricant may be delivered to the wick in any suitable manner such as by conduits 62 which are connected to elbows 64 extending through the upper plate 44. The wick 42 may be of any suitable material such as felt while the plates 44 and 46 may be of a lightweight metal such as aluminum or plastic.

In operation, the sidewall stock 14 is fed by the sidewall feeder 15 to the sidewall blanking die 16 which is driven by means not shown but which are well known in the art so as to reciprocate vertically in a timed sequence for cutting the sidewall blanks 50. As each sidewall blank is cut, it is placed on the transfer turret 18. As the blanking die moves upward following the cut, the blank 50 is stepped to a position adjacent to the applicator 41. When the blanking die 16 is moved downward for cutting the next sidewall blank, the applicator 44 is also moved downward so that the inner edge 48 of the wick 42 engages the edge 48 of the blank 50. The blank is then stepped through the machine which performs the various cup forming operations as discussed above.

While only a single embodiment of the invention has been illustrated and described, it is not intended to be limited thereby but only by the scope of the pending claims.

I claim:

1. An apparatus for making cups which includes means for forming blanks of a cup sidewall portion, means for forming the cup sidewall blank into a frustoconical configuration by sealing the opposite edges and for applying a bottom portion, and means for curling and rolling the upper edge of the cup to form a rim, the improvement comprising a lubricant applicator disposed between the blank forming means and the cup forming means and constructed and arranged for applying lubricant to the upper edge of the blank prior to formation of said cup to minimize frictional heating during the rim forming operation, said lubricant applicator including arcuate wick means and a carrier for said wick means, means mounted on said carrier for supplying lubricant to said wick means, said carrier being reciprocally mounted on said apparatus for moving the wick means into and out of engagement with the edge of successive cup sidewall blanks after the same have been formed by said blank forming means so that lubricant will be applied to the edge of said blanks.

2. The machine set forth in claim 1 wherein said blank forming means comrpises a reciprocating die cutting means, said applicator being coupled to said die cutting means for movement in synchronism therewith.

3. An apparatus for making cups which includes means for forming blanks of a cup sidewall portion, means for forming the cup sidewall blank into a frustoconical configuration by sealing the opposite edges and for applying a bottom portion, and means for curling and rolling the upper edge of the cup to form a rim, the improvement comprising a lubricant applicator disposed between the blank forming means and the cup forming means and constructed and arranged for applying lubricant to the upper edge of the blank prior to formation of said cup to minimize frictional heating during the rim forming operation, said lubricant applicator including arcuate wick means and carrier means for said wick means, said carrier means being reciprocally mounted on said apparatus for movement into and out of engagement with cup sidewall blanks after the same have been formed by said blank forming means, said carrier means comprising upper and lower interconnected plae means, said wick means being disposed between said plate means and having an edge extending from one side thereof for engagement with said cup blank upon reciprocating movement, and means for delivering lubricant to said carrier means.

4. The machine set forth in claim 3 wherein said blank forming means comprises a reciprocating die cutting means, said applicator being coupled to said die cutting means for movement in synchronism therewith.

5. The cup making machine as set forth in claim 3 and including a recess formed in one of said plate means for receiving said wick means.

* * * * *